United States Patent [19]

Lovik

[11] Patent Number: 5,045,011

[45] Date of Patent: Sep. 3, 1991

[54] FLYING BALLOON TOY

[76] Inventor: Craig J. Lovik, 8036 Makah, Blaine, Wash. 98230

[21] Appl. No.: 531,929

[22] Filed: Jun. 1, 1990

[51] Int. Cl.[5] ..... A63H 27/00; A63H 3/06; A63B 65/08; A63B 65/00

[52] U.S. Cl. ..... 446/46; 446/225; 273/426; 273/428; 272/114

[58] Field of Search ..... 446/46, 47, 48, 220, 446/225, 226, 230, 231; 273/424, 425, 426, 427, 428; 272/114

[56] References Cited

U.S. PATENT DOCUMENTS

| | | | |
|---|---|---|---|
| D. 285,812 | 9/1986 | Green, Jr. | 273/426 X |
| 810,690 | 1/1906 | Weiss | 446/226 |
| 1,471,886 | 10/1923 | Dessau | 446/220 |
| 1,858,460 | 5/1932 | Ranseen | 446/225 X |
| 2,835,073 | 5/1958 | Dame | 446/40 |
| 2,864,201 | 12/1958 | Leise | 446/46 |
| 3,580,580 | 5/1971 | Wark et al. | 446/48 X |
| 3,591,975 | 7/1971 | Terc | 446/225 |
| 3,594,945 | 7/1971 | Turney | 446/48 |
| 3,716,229 | 2/1973 | Van Der Cleyen et al. | 272/114 |
| 3,724,122 | 4/1973 | Gillespie, Sr. | 446/46 |
| 3,758,985 | 9/1973 | Heisler | 446/46 |
| 3,765,122 | 10/1973 | English | 446/48 |
| 4,030,237 | 6/1977 | Lewis | 446/220 X |
| 4,135,325 | 1/1979 | Lehman | 446/46 |
| 4,174,834 | 11/1979 | De Martino | 446/48 X |
| 4,262,911 | 4/1981 | Opresik et al. | 446/46 |
| 4,335,536 | 6/1982 | Magid et al. | 446/46 |
| 4,421,320 | 12/1983 | Robson | 273/425 |
| 4,591,164 | 5/1986 | Blight | 273/425 |
| 4,889,346 | 12/1989 | Mineart | 273/424 |
| 4,940,441 | 7/1990 | Novinsky | 446/46 |

FOREIGN PATENT DOCUMENTS

| | | | |
|---|---|---|---|
| 0213662 | 3/1987 | European Pat. Off. | 272/114 |
| 7005221 | 4/1970 | Netherlands | 272/114 |
| 861674 | 2/1961 | United Kingdom | 446/220 |

*Primary Examiner*—Robert A. Hafer
*Assistant Examiner*—D. Neal Muir
*Attorney, Agent, or Firm*—Cassidy, Vance & Tarleton

[57] ABSTRACT

A flying balloon toy (10) having an inflatable balloon (14) frictionally engaged with an aerodynamic body (12) formed of lightweight material that gives additional drag without increasing the weight to yield increased flight time while being safe for use indoors. The body (12) has a disk-shaped portion (22) with a central opening (26) formed therein that is aligned with the rotational axis (36). The collar portion (24) includes concave sides (34) to frictionally engage the side wall (16) of the balloon (14).

16 Claims, 4 Drawing Sheets

FIG. 4
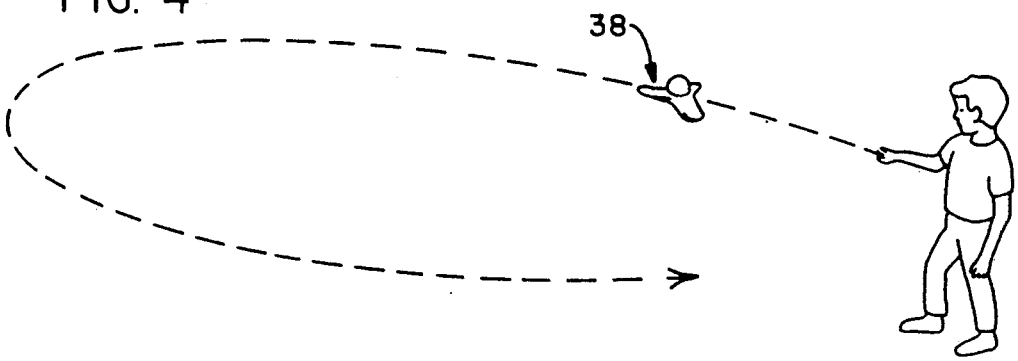
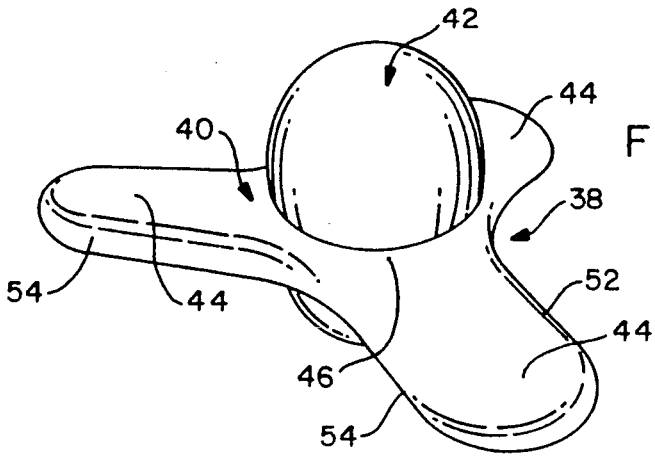
FIG. 5
FIG. 6
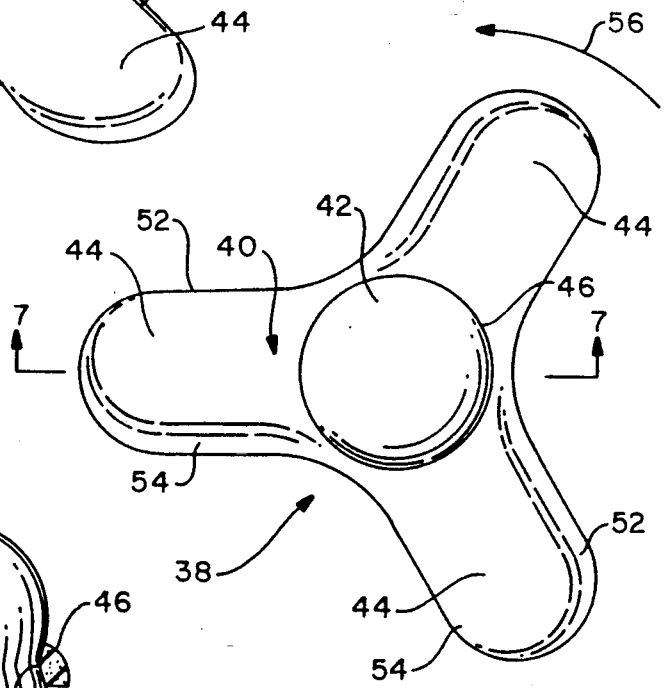
FIG. 7
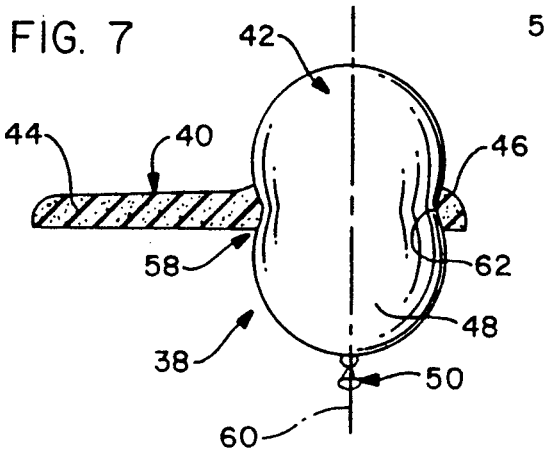

FIG. 8
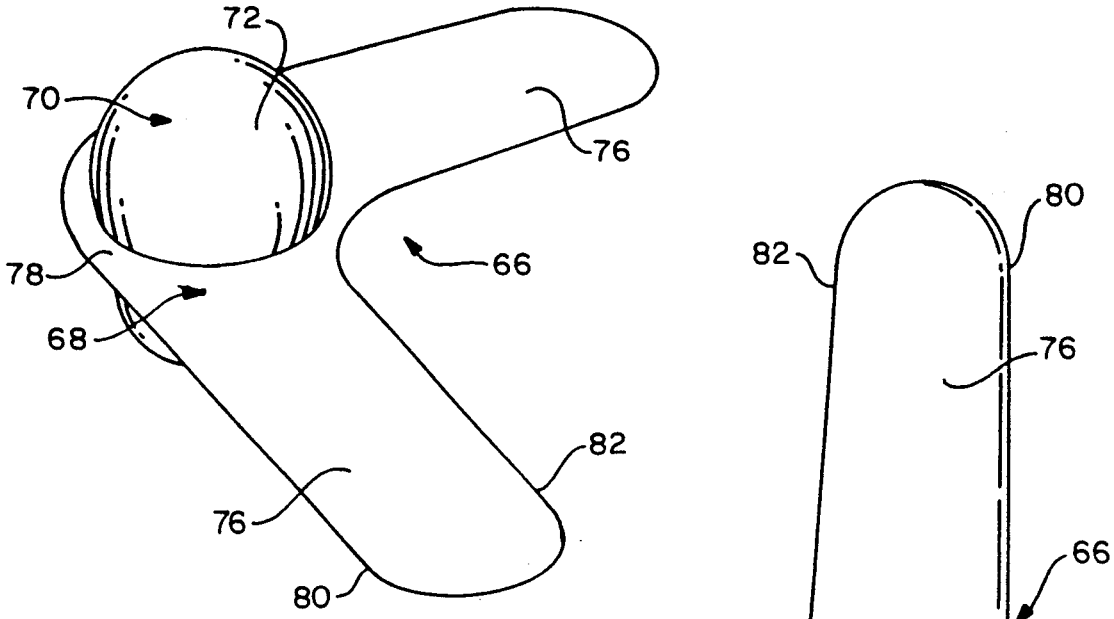
FIG. 9
FIG. 10
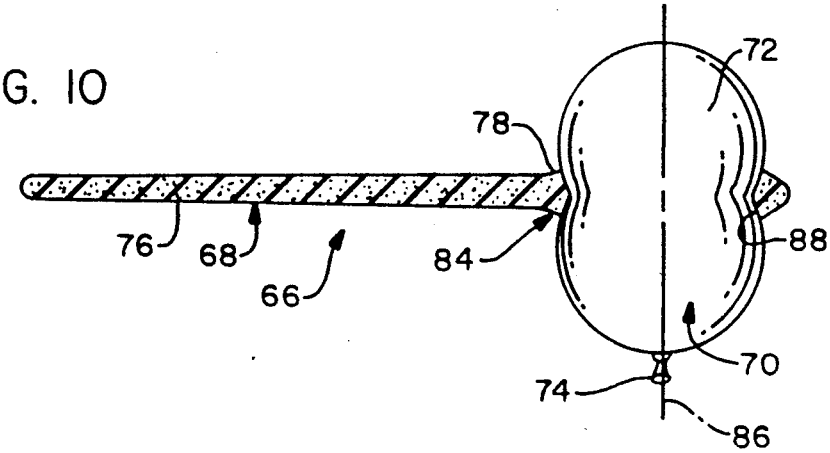

FLYING BALLOON TOY

TECHNICAL FIELD OF THE INVENTION

The present invention relates generally to toys, and, more particularly, to toys that, in combination with one or more balloons, are designed to fly through the air with aerodynamic stability such that the toy can be launched and directed towards a target or launched for random flight.

BACKGROUND OF THE INVENTION

Gas-filled spheres and bladders have been used in the past to improve the aerodynamic performance of flying objects. For instance, U.S. Pat. No. 303,885 issued to E. & H. Ridge on Aug. 19, 1884, discloses a flying target consisting substantially of a flat ring having a central opening in which an inflatable balloon or "bulb" is held. The bulb is manually inflated to give body to the target. Two semicircular wires or bands are pivotally mounted to the ring and are swung outward to a plane that is at right angle to the surface of the ring to closely fit against the inflated bulb to hold it in position and prevent over-inflation. The bulb is inflated through a tube mounted to the ring that is pinched, preferably by the user's teeth, to seal the bulb. The drawback to Ridge et al. is that the bulb is retained within the ring by both the inflation tube and the pair of semicircular wires, which adds to the complexity and weight of the target. While the target may be suitable for outdoor use on a shooting range, its weight and complexity make it unsuitable for indoor use especially by young children.

U.S. Pat. No. 4,262,911, issued to Opresik et al. on Apr. 21, 1981, discloses a "Martian Flyer" comprising a circular wing having a solid generally spherical hollow body in the center. The body is formed of a solid material, such as clear plastic, and is either integrally formed with the wing or is removably attached to the wing by threads, springs, or other fastening means. Because the flying game device of Opresik et al. is specifically designed for out-of-doors use, it must be constructed of dense materials that are durable to withstand impacts and be less affected by wind. As such, the Opresik et al. "Martian Flyer" is also unsuitable for indoor use. In addition, Opresik et al. contains no teaching or suggestion of using an inflatable balloon, nor is there any teaching or suggestion in Opresik et al. of how to removably mount such a balloon on a disk.

Another disadvantage of prior art devices is their inability to accommodate spheres or balloons filled with a gas that is lighter than air, such as helium. Because of the porous nature of the material of these balloons, and in particular latex balloons, helium passes readily through the material. Thus, helium-filled latex balloons tend to leak and reduce in size over a period of several hours. As a result, the balloons cannot be retained within the device and will easily fall out or be knocked out. Consequently, there is a need in the art for a flying toy that can accommodate an inflatable balloon, and, in addition, there is a need in the art for a flying toy that can accommodate a helium or other lighter-than-air gas-filled balloon.

SUMMARY OF THE INVENTION

The present invention is directed to a flying balloon toy for use with inflatable balloons of the type having a constricted neck portion terminating at one end in an inflation aperture and at the other end in an imperforate expandable side wall. The toy comprises a balloon, an aerodynamic body that rotates about a rotational axis when airborne, and holding means for maintaining the balloon in engagement with the aerodynamic body when the balloon is inflated. More particularly, the aerodynamic body has a substantially planar shape and the holding means preferably comprises an opening formed in the body that is sized to frictionally engage the balloon to hold the balloon to the body.

In accordance with another aspect of the present invention, the opening formed in the body is axially aligned with the rotational axis of the body such that the balloon will be axially aligned with the rotational axis of the body when the balloon is held in the opening.

In accordance with yet another aspect of the present invention, the balloon is held in the opening to extend outward from both sides of the planar body.

In accordance with a further aspect of the present invention, a contracting means is provided to hold the balloon in engagement with the body as the balloon contracts, the contracting means comprising the aerodynamic body being formed into a first member and a second member, with the first and second members being pivotally attached to each other and biased to move together to contract the opening in response to contraction of the inflatable balloon.

In accordance with an alternative embodiment of the present invention, the flying balloon toy comprises an inflatable balloon of the type having a constricted neck portion that terminates at one end in an inflation aperture and at the other end in an imperforate expandable side wall; an aerodynamic body having a V-shaped planar configuration formed of two outwardly projecting wings joined together at a vertex, the aerodynamic body rotating about a rotational axis located at the vertex of the V-shaped planar body when the toy is airborne; and means for holding the balloon in engagement with the aerodynamic body when the balloon is inflated to provide aerodynamic stability to the toy when airborne.

In accordance with another aspect of the present invention, the holding means preferably comprises an opening formed in the aerodynamic body that is sized and shaped to frictionally engage the balloon and is axially aligned with the rotational axis of the body such that the balloon is held in the opening to be axially aligned with the rotational axis of the body and to extend outward from both sides of the body.

In accordance with yet another embodiment of the present invention, the flying balloon toy comprises an inflatable balloon of the type having a constricted neck portion terminating at one end in an inflation aperture and at the other end in an imperforate expandable side wall; and aerodynamic body having a substantially planar shape with a plurality of wings projecting outward from a central hub, the aerodynamic body having a rotational axis located at the central hub; and holding means for holding the balloon in engagement with the aerodynamic body when the balloon is inflated to provide aerodynamic stability to the toy when airborne.

In accordance with another aspect of the present invention, the holding means comprises an opening formed in the hub that is axially aligned with the rotational axis of the body such that the balloon is held in the opening to extend outward from both sides of the planar body in axial alignment with the rotational axis of the planar body.

In accordance with yet another embodiment of the present invention, the flying balloon toy comprises an inflatable balloon; an aerodynamic disk-shaped body having a substantially concave lower surface, said body having a rotational axis located at the center point of the disk-shaped body; and means for holding the balloon in engagement with the aerodynamic body when the balloon is inflated.

In accordance with yet another aspect of the present invention, the holding means preferably comprises an opening formed in the disk-shaped body that is sized and shaped to frictionally engage the balloon, the opening preferably being axially aligned with the rotational axis of the disk-shaped body such that the balloon is held in the opening to extend outward from both sides of the planar body and in axial alignment with the rotational axis of the body.

As will be readily appreciated from the foregoing description, the present invention provides a flying balloon toy that readily accommodates inflatable balloons that are commercially available. More particularly, the present invention permits an inflatable balloon to be easily and quickly inserted and held within a lightweight flying toy to provide aerodynamic stability to the toy when airborne. In addition, the present invention increases flight time of the toy by increasing surface area and drag without increasing weight and complexity. As such, the flying balloon toy formed in accordance with the present invention is ideally suited for indoor use, especially by young children. Furthermore, the present invention also provides a balloon holding structure that contracts in response to contraction of the balloon. This is particularly useful with helium and other similar gas-filled balloons that tend to leak at a fairly rapid rate, thus causing contraction in the size of the balloon. The holding means of the present invention responds to contraction of the balloon to maintain engagement of the balloon with the aerodynamic body.

SUMMARY OF THE INVENTION

The foregoing and other features and advantages of the present invention will be more readily appreciated as the same becomes better understood from the detailed description of the invention when taken in conjunction with the following drawings, wherein:

FIG. 4 is an isometric view of an alternative embodiment of the flying balloon toy formed in accordance with the present invention illustrating the path of flight when in use;

FIG. 5 is an isometric view of the flying balloon toy of FIG. 4;

FIG. 6 is a top plan view of the flying balloon toy of FIG. 5;

FIG. 7 is a cross sectional view taken along lines 7—7 of the flying balloon toy of FIG. 6;

FIG. 8 is an isometric view of yet another alternative embodiment of the flying balloon toy formed in accordance with the present invention;

FIG. 9 is a top plan view of the flying balloon toy of FIG. 8;

FIG. 10 is a cross sectional side view taken along lines 10—10 of the flying balloon toy of FIG. 9;

DETAILED DESCRIPTION OF THE PREFERRED EMBODIMENT

Figure 1:
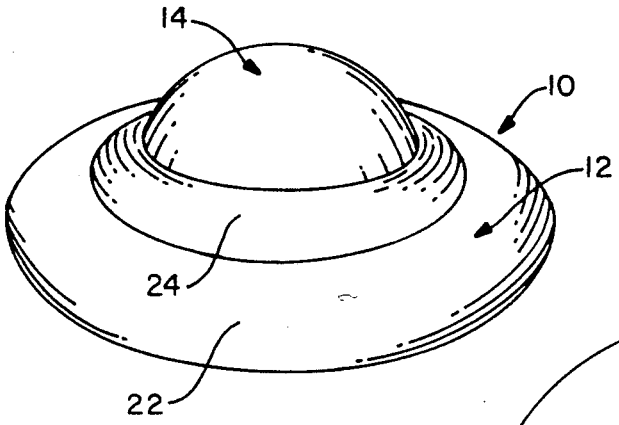
FIG. 1 is an isometric view of a disk-shaped flying balloon toy formed in accordance with the present invention.
Figure 2:
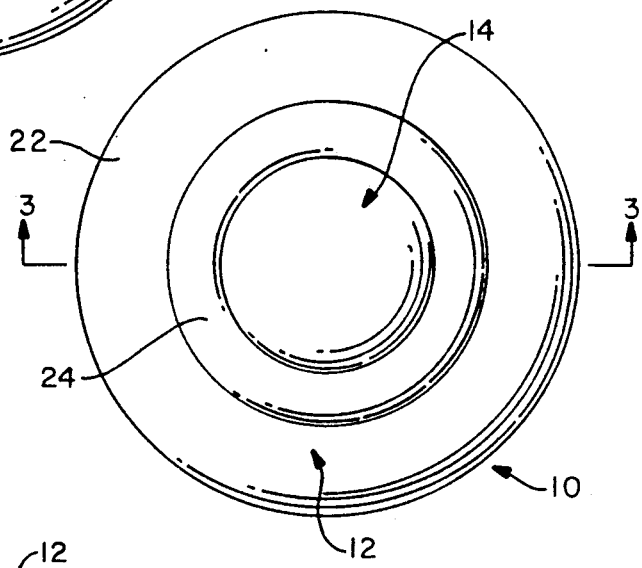
FIG. 2 is a top plan view of the flying balloon toy of FIG. 1.
Figure 3:
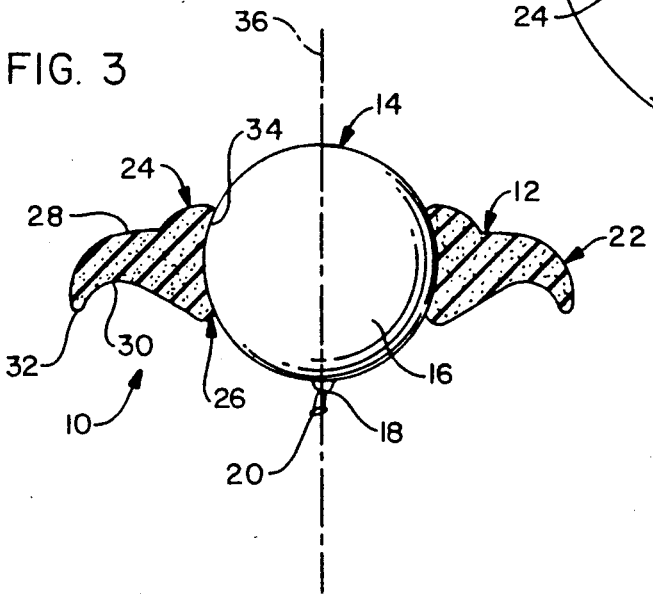
FIG. 3 is a cross sectional view taking along lines 3—3 of the flying balloon toy of FIG. 2.

The present invention is directed to a flying toy that incorporates one or more balloons in combination with an aerodynamic structure to fly through the air with aerodynamic stability. FIGS. 1–3 illustrate a preferred embodiment of a flying balloon toy constructed in accordance with the present invention. In particular, the flying balloon toy 10 is formed of an aerodynamic body 12 and an inflatable balloon 14. As will be readily apparent to one skilled in the art, the balloon 14 is completely conventional in terms of shape, size, material and color, and, since it is readily commercially available, it will not be described in detail herein. Briefly, the balloon 14 has a general spherical shape formed by the expandable side walls 16. As shown more clearly in FIG. 3, the balloon 14 has a constricted neck portion 18 that terminates at one end in an inflation aperture 20 and at the other end in an imperforate, inflatable side wall 16. While the size of the balloon 14 is not critical, the degree and manner of inflation thereof has been controlled in accordance with the invention to produce a size and shape that, while it may be adjusted to suit the needs of a particular flying toy, is selected to fit snugly within the aerodynamic body 12, as will be described in more detail below. As shown more clearly in FIG. 3, the neck portion 18 is knotted to seal the balloon 14 in an inflated configuration.

In order to generate lift, the aerodynamic body 12 is formed to have camber. More specifically, the aerodynamic body 12 has a disk-shaped portion 22 and an enlarged collar portion 24 that is integrally formed in the center of the disk portion 22 to define an opening 26 having a vertical axis 36. The disk-shaped portion 22 has a substantially convex top surface 28 that curves downward to meet a substantially concave bottom surface 30 to form an annular lip 32.

The balloon 12 must be held in snug engagement with the body 12 to prevent unintentional removal during flight. To this end, the collar portion 24 has generally concave-shaped sides 34 with a relatively large radius formed around the entire inside diameter of the opening 26. Because the collar portion 24 is formed to have a greater thickness than the disk-shaped portion 22, as illustrated in FIG. 3, there will be greater surface contact area between the balloon 14 and the body 12. In order to maintain a minimum weight, a lightweight material, such as polyurethane foam or styrofoam, is used to construct the aerodynamic body 12. To ensure aerodynamic stability, it is important that the opening 26 be axially aligned with the vertical axis 36 of the aerodynamic body 12. Thus, when the balloon 12 is mounted in the opening 26, it will be aligned with the vertical axis of the body 12. As such, the toy 10 will have aerodynamic stability as it spins and a longer flight time.

The flying balloon toy 10 is prepared for use by first inflating the balloon 14 and tying or otherwise securing the neck portion 18. The balloon 14 is preferably inflated to a size that will snugly fit within the opening 26 without creating an unnatural bulge of the balloon material over the collar portion 24. The balloon 14 is then inserted into the opening 26 until it is snugly seated in the concave sides 34. When so mounted, the balloon 12 will project both above and below the plane of the body 12 without interference. With the balloon 14 so mounted in the body 12, the toy 10 is then hand launched in a conventional manner. More particularly, the user grips the disk portion 22 with the fingers under the annular lip 32 and then flings the toy 10 into the air with a snap of the wrist to impart a spin. FIG. 4, which illustrates an alternative flying balloon toy 38, shows the technique used to launch the invention.

The flying balloon toy 38 illustrated in FIG. 4 is shown and described more fully in connection with FIGS. 5–7. As shown therein, the flying balloon toy 38 is formed in accordance with the present invention to include an aerodynamic body 40 and an inflatable balloon 42. The balloon 42 is of the conventional type described in conjunction with the flying balloon 10 of FIGS. 1–3, and it includes an inflatable side wall 48 with a constricted neck portion 50.

The aerodynamic body 40 is formed with a central hub 46 having three blades 44 projecting radially outward therefrom and spaced equidistantly about the circumference of the hub 46. More particularly, the blades 44 lie in the same plane and are spaced approximately 120 degrees apart. The blades 44 on the toy 38 are designed to generate lift when the toy rotates in a counterclockwise direction as viewed from the top, indicated by arrow 56 in FIG. 6. To accomplish this, each of the blades 44 has a cross-sectional shape that is arched along the top surface to create camber, i.e., a leading edge 52 having a thickness that tapers downward to a thinner trailing edge 54.

A central opening 58 is formed in the hub 46 with an axial bore that is aligned with a rotational axis 60 of the aerodynamic body 40. The opening 58 has an internal wall 62 that frictionally engages the side wall 48 of the balloon 42. As such, the balloon 42 is held in snug engagement with the body 40 and in axial alignment with the rotational axis 60. Although the balloon 42 is shown having an hourglass shape because the opening 58 has a smaller diameter than the natural diameter of the inflated balloon 42, it is to be understood that the opening 58 may be formed to have a larger diameter such that the balloon 42 can assume its natural spherical shape while still being frictionally engaged with the internal wall 62.

The toy 38 is prepared for use in the same manner as the flying balloon toy 10 described in conjunction with FIGS. 1–3. The balloon 42 is inflated and mounted in the body 40. It is then hand launched by a user 64 as shown in FIG. 4. The toy 38 is typically launched by grasping one of the blades 44 with either hand and throwing it such that it is spun in a counterclockwise direction about the rotational axis 60 to generate momentum and lift. The additional surface area provided by the balloon 42 projecting on both sides of the body 40 creates drag without creating any substantial weight. As such, the toy 38 will fly at a slower air speed with good stability, making it suitable for use indoors as well as outdoors.

FIGS. 8–10 illustrate yet another alternative embodiment of the invention wherein the flying balloon toy 66 is in the shape of a conventional boomerang. The toy 66 includes an aerodynamic body 68 and an inflatable balloon 70. The balloon 70 is the conventional type balloon described above in conjunction with FIGS. 1–7 and will not be described in detail herein except to note that the balloon 70 includes a side wall 72 and a constricted neck portion 74.

The aerodynamic body 68 includes a pair of blades 76 that project radially outward from a central hub 78 and are positioned approximately 90 degrees apart. Each blade 76 has a leading edge 80 and a trailing edge 82. In order to generate lift as the body 68 travels through the air, the leading edge 80 of each blade will be slightly thicker than the trailing edge 82 to form an arch or camber. The hub 78 includes a central opening 84 that is axially aligned with the rotational axis 86 of the body 68. The opening 84 includes internal side walls 88 that frictionally engage the side wall 72 of the balloon 70 to hold the balloon 70 in engagement with the body 68. Although the balloon 70 is shown having an hourglass shape, it is to be understood that the opening 84 may be sized to permit the balloon 70 to assume its natural spherical shape when inflated while snugly engaging the balloon 70. In order to maintain as light a weight as possible, the body 68 is preferably constructed of lightweight material, such as that described above in conjunction with the flying toy 10 illustrated in FIGS. 1–3. The flying toy 66 illustrated in FIGS. 8–10 is used in the same manner as described above with respect to the alternative embodiment illustrated in FIGS. 1–3 and FIGS. 4–6, and more particularly as shown in use in FIG. 4. However, the flying balloon toy 66 illustrated in FIGS. 8–10 may be hand launched to rotate in either direction to achieve the V-shaped flight path of a conventional boomerang.

Figure 11:
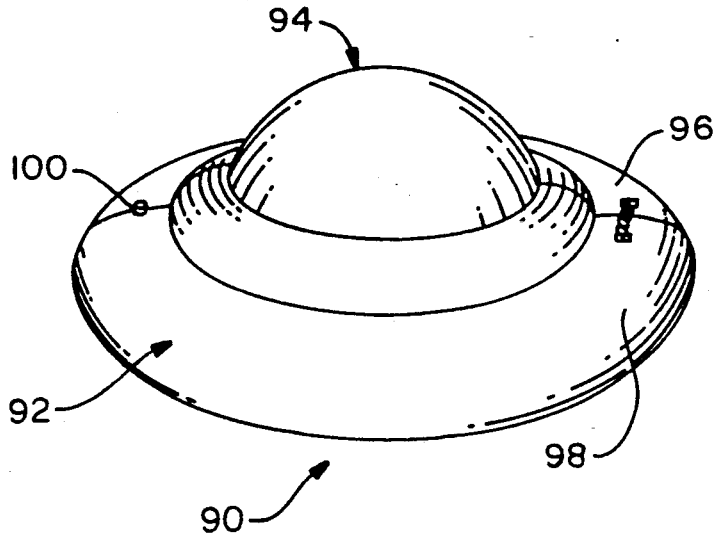
FIG. 11 is an isometric view of an alternative embodiment of a disk-shaped flying balloon toy formed in accordance with the present invention.
Figure 12:
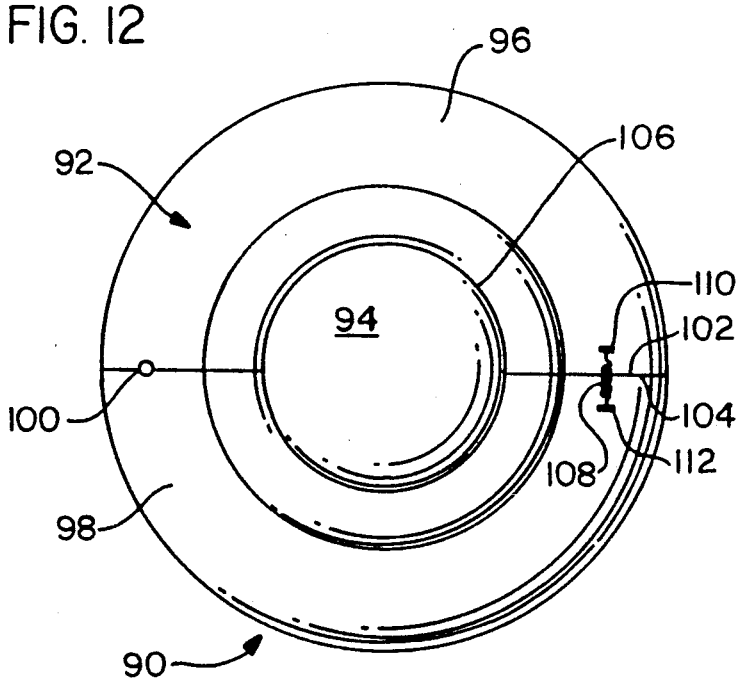
FIG. 12 is a top plan view of the flying balloon toy of FIG. 11.

FIGS. 11 and 12 illustrate yet another alternative embodiment of a flying balloon toy 90 having a disk-shaped aerodynamic body 92 encircling a helium-filled balloon 94. It is well-known in the art that such helium-filled balloons tend to lose the gas at a rapid rate, resulting in shrinkage of the balloon 94. Consequently, it is desirable to have the aerodynamic body 92 equipped to maintain contact with the balloon 94 as it shrinks. To this end, the aerodynamic body 92, which is nearly identical to the aerodynamic body 12 described above in conjunction with FIGS. 1–3, is formed into right and left halves 96 and 98 respectively. Each of the halves 96 and 98 are pivotally joined on one side by a pivot pin 100 in a conventional fashion. With the right and left halves 96 and 98 so attached, they pivot about the pin 100 so that the free ends 102 and 104 slide together and overlap to constrict or dilate the opening 106 in which the balloon 94 is held. A biasing means in the form of a helical spring 108 has its ends attached to a tab 110 and 112 formed on or near each free end 102 and 104 to bias the right and left halves 96 and 98 together.

With this embodiment, the size of the opening 106 is changed in response to change in the diameter of the balloon 94. More particularly, as the diameter of the balloon 94 decreases due to loss of internal gas, the helical spring 108 pulls the free ends 102 and 104 of the body 92 together to constrict the opening 106. It is to be understood, however, that other methods may be used for biasing the halves 96 and 98 together, and other methods may also be used to pivotally attach the halves 96 and 98 together, without departing from the scope of the invention.

While a preferred embodiment of the invention has been illustrated and described, it is to be understood that various changes may be made therein without departing from the spirit and scope of the invention. Thus, the invention is to be limited only by the scope of the claims that follow.

The embodiment of the invention in which an exclusive property or privilege is claimed are defined as follows:

1. A flying balloon toy for use with an inflatable balloon of the type having a constricted neck portion that terminates at one end in an inflation aperture and at the other end in an imperforate sidewall, the toy comprising:

a rigid aerodynamic body, formed of a stiff, lightweight material, that is intended to rotate about a rotational axis when thrown by a user, and means for holding the balloon in readily removable engagement in a central portion of said aerodynamic body when the balloon is inflated, said holding means comprising an opening formed in said body and having sides for engaging the balloon, extends above and below said central portion to provide aerodynamic stability to the toy when thrown by a user.

2. The toy of claim 1, wherein said axial bore is axially aligned with the rotational axis of said body such that the balloon will be axially aligned with the rotational axis of said body.

3. The toy of claim 2, further comprising contracting means for contracting said axial bore in response to contraction of the balloon.

4. The toy of claim 3, wherein said contracting means comprises said aerodynamic body being formed into a first member and a second member, said first and second members having first portions pivotally attached to each other and second portions biased to move together to thereby contract said axial bore in response to contraction of the balloon.

5. A flying balloon toy comprising:

an inflatable balloon of the type having a constricted neck portion terminating at one end in an inflation aperture and at the other end in an imperforate expandable side wall;

an aerodynamic body having a V-shaped planar configuration formed of two outwardly projecting wings joined together at a vertex that is intended to rotate about a rotational axis located at said vertex when thrown by a user; and means for holding said balloon in readily removable engagement in a central portion at said vertex of said aerodynamic body when said balloon is inflated, said holding means comprising an opening having sides for frictionally engaging said balloon, wherein said balloon projects above and below said central portion to provide aerodynamic stability to the toy when airborne.

6. The toy of claim 5, wherein said opening is axially aligned with the rotational axis of said body.

7. The toy of claim 6, wherein said balloon is inflated with a gas.

8. The toy of claim 7, wherein said gas is lighter than the ambient atmosphere.

9. A flying balloon toy comprising:

an inflatable balloon of the type having a constricted neck portion terminating at one end in an inflation aperture and at the other end in an imperforate expandable side wall;

a planar, disc-shaped aerodynamic body having a plurality of wings projecting outward from a central hub that is intended to rotate about a rotational axis located at said central hub when thrown by a user; and means for holding said balloon in readily removable engagement with said central hub when said balloon is inflated, said holding means comprising an opening in said hub having sides to frictionally engage said balloon when said balloon is inflated, wherein said balloon extends above and below said central hub to provide aerodynamic stability to the toy when thrown by a user.

10. The toy of claim 9, wherein said opening is axially aligned with the rotational axis of said body in said hub.

11. The toy of claim 10, wherein said balloon is inflated with a gas.

12. The toy of claim 11, wherein said gas is lighter than the ambient atmosphere.

13. A flying balloon toy comprising:

an inflatable balloon of the type having a constricted neck portion terminating at one end in an inflation aperture and at the other end in an imperforate inflatable side wall;

an aerodynamic disk-shaped body having a substantially concave lower surface that is intended to rotate about a rotational axis located at the center point of said disk-shaped body when thrown by a user; and means for holding said balloon in engagement at the center point of said aerodynamic body when said balloon is inflated, said holding means comprising an opening formed in said disk-shaped body having sides to frictionally engage said balloon, wherein said balloon extends above and below the center point to provide aerodynamic stability to the toy when thrown by a user .

14. The toy of claim 13, wherein said opening is axially aligned with the rotational axis of said disk-shaped body.

15. The toy of claim 14, wherein said balloon is inflated with a gas.

16. The toy of claim 15, wherein said gas is lighter than the ambient atmosphere.

* * * * *